US010821574B2

(12) United States Patent
Pan et al.

(10) Patent No.: US 10,821,574 B2
(45) Date of Patent: Nov. 3, 2020

(54) PIVOTING CLAMPING ASSEMBLY

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Di-Meng Pan, Shenzhen (CN); Ting-Hui Deng, Shenzhen (CN); Zhi-Yu Hu, Shenzhen (CN); Long-Fong Chen, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 237 days.

(21) Appl. No.: 15/871,116

(22) Filed: Jan. 15, 2018

(65) Prior Publication Data

US 2019/0111544 A1 Apr. 18, 2019

(30) Foreign Application Priority Data

Oct. 13, 2017 (CN) ..... 2017 1 0954365

(51) Int. Cl.
*B25B 5/04* (2006.01)
*B25B 5/16* (2006.01)

(52) U.S. Cl.
CPC ..... *B25B 5/04* (2013.01); *B25B 5/163* (2013.01)

(58) Field of Classification Search
CPC ..... B25B 5/04; B25B 11/00; B25B 11/02; B25B 5/145; B32Q 3/00; B32Q 3/06; B32Q 3/002; G11B 33/04; G11B 33/0405
USPC ..... 269/237, 254 CS, 73, 109, 110, 111, 12, 269/113
See application file for complete search history.

(56) References Cited

U.S. PATENT DOCUMENTS

2011/0024962 A1* 2/2011 Zhang ..... B25B 5/06 269/107
2015/0282580 A1* 10/2015 Chen ..... A45C 13/007 206/425

FOREIGN PATENT DOCUMENTS

DE 2809584 A1 * 9/1979 ..... B25B 5/142

OTHER PUBLICATIONS

Translation (Year: 1979).*

* cited by examiner

*Primary Examiner* — Tyrone V Hall, Jr.
*Assistant Examiner* — Abbie E Quann
(74) *Attorney, Agent, or Firm* — ScienBiziP, P.C.

(57) ABSTRACT

A pivoting clamping assembly includes a carrier, clamping arm pivotably coupled to the carrier and configured to clamp or release a workpiece on the carrier, a lock arranged on the carrier and configured to lock the clamping arm when the clamping arm is rotated toward the workpiece, and at least one clamping block coupled to the clamping arm by a shaft and at least one resilient member. The shaft pivotably couples a pivoting joint of the at least one clamping block to the clamping arm. The at least one resilient member is coupled between the clamping block and the clamping arm.

8 Claims, 3 Drawing Sheets

PIVOTING CLAMPING ASSEMBLY

CROSS-REFERENCE TO RELATED APPLICATIONS

This application claims priority to Chinese Patent Application No. 201710954365.1 filed on Oct. 13, 2017, the contents of which are incorporated by reference herein.

FIELD

The subject matter herein generally relates to clamping assemblies, and more particularly to a clamping assembly having a pivotable clamping arm.

BACKGROUND

Generally, a pivoting clamping assembly includes a carrier and a clamping arm pivotably coupled to the carrier to clamp a workpiece on the carrier. Different sides of the clamping arm contact the workpiece at different times during a process of clamping the workpiece, which can cause the clamping arm to get stuck. This is usually solved by increasing a gap between the workpiece and the clamping arm, which thereby decreases an accuracy of clamping the workpiece.

BRIEF DESCRIPTION OF THE DRAWINGS

Implementations of the present disclosure will now be described, by way of example only, with reference to the attached figures.

DETAILED DESCRIPTION

Figure 1:
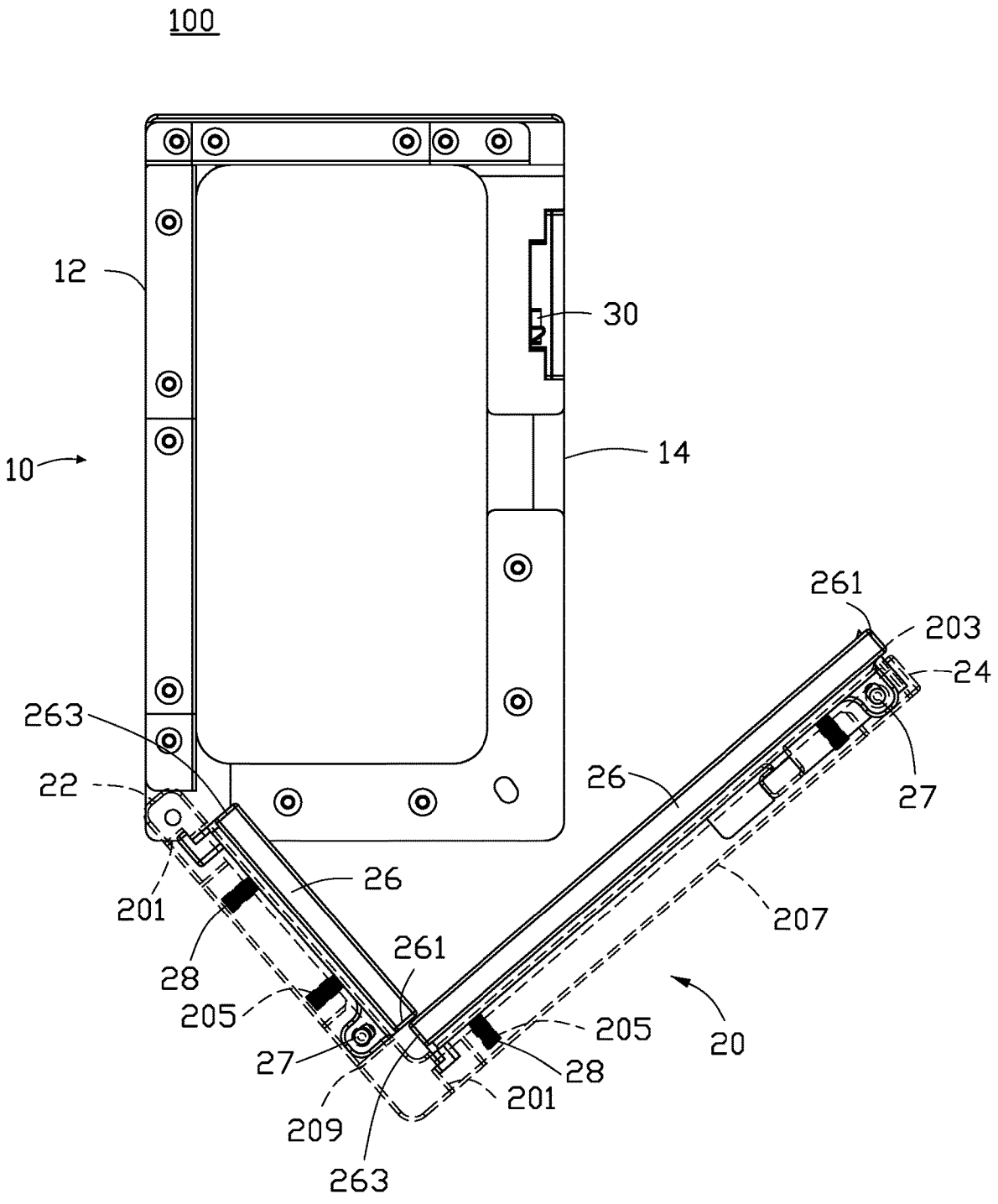
FIG. 1 is an assembled, top view of an exemplary embodiment of a pivoting clamping assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 illustrates an embodiment of a pivoting clamping assembly 100. The pivoting clamping assembly 100 can include a carrier 10, a clamping arm 20, and a lock 30. The clamping arm 20 is pivotably coupled to the carrier 10, and the clamp is located on the carrier 10. The clamping arm 20 can pivot to cooperate with the lock 30 to lock or release a workpiece 40 (shown in FIG. 2) on the carrier 10.

A periphery of the carrier 10 includes a first portion 12 and a second portion 14. The clamping arm 20 is pivotably coupled to the second portion 14. The first portion 12 and the clamping arm 20 are oppositely arranged and cooperatively clamp the workpiece 40. In at least one embodiment, the clamping arm 20 and the first portion 12 are substantially L-shaped and cooperatively surround the carrier 10. The clamping arm 20 includes a pivoting end 22 and a locking end 24. The pivoting end 22 pivotably couples the clamping arm 20 to the carrier 10 to enable the clamping arm 20 to pivot within the second portion 14. The locking end 24 corresponds to the lock 30 to clamp or release the clamping arm 20 within the second portion 14. In detail, the lock 30 is arranged on the second portion 14 of the carrier 10 corresponding to the locking end 14. The locking end 24 clamped by the lock 30 causes the clamping arm 20 to be fixed within the second portion 14 to cooperatively clamp the workpiece 40 with the first portion 12. When the locking end 24 is released from the lock 30, the clamping arm 20 can pivot open within the second portion 14 to release the workpiece 40 from the carrier 10.

The clamping arm 20 can include at least one clamping block 26. In the illustrated embodiment, there are two clamping blocks 26. The clamping block 26 is coupled to the clamping arm 20 by a shaft 27 and at least one resilient member 28 (the figure shows dashed lines to illustrate assembly of the clamping block 26 on the clamping arm 20). In the illustrated embodiment, each clamping block 26 includes two resilient members 28. The shaft 27 pivotably couples a pivoting joint 261 of the clamping block 26 to the clamping arm 20. The resilient member 28 is located between the clamping block 26 and the clamping arm 20. The clamping block 26 can pivot on the clamping arm 20 and resiliently abut against the workpiece 40 such that the clamping arm 20 does not get stuck.

The clamping block 26 includes a hooking end 263 opposite from the pivoting joint 261. The hooking end 263 can hook into a hooking groove 201 defined in the clamping arm 20. The hooking end 263 and the pivoting joint 261 can enable the clamping block 26 to pivot on the clamping arm 20. In at least one embodiment, the clamping block 26 is located on an inner side 203 of the clamping arm 20. The inner side 203 faces the workpiece 40. When the clamping arm 20 is pivoted toward the workpiece 40, the clamping block 26 located on the inner side 203 abuts against the workpiece 40. The inner side 203 can define at least one slot 205. The slot 205 corresponds to the resilient member 28 to receive the resilient member 28. In detail, the clamping arm 20 includes a long section 207 and a short section 209. Each of the long section 207 and the short section 209 has a corresponding clamping block 26 on the inner side 203. The pivoting joint 261 of the clamping block 26 of the long section 207 is adjacent to the locking end 24 of the clamping arm 20, and the hooking end 263 is adjacent to the short section 209. The pivoting joint 261 of the clamping block 26 of the short section 209 is adjacent to the long section 207, and the hooking end 263 is adjacent to the pivoting end 22 of the clamping arm 20. Thus, the hooking end 263 of the clamping block 26 of the long section 207 and the pivoting joint 261 of the clamping block 26 of the short section 209 are adjacent to each other at a junction of the long section 207 and the short section 209.

Figure 2:
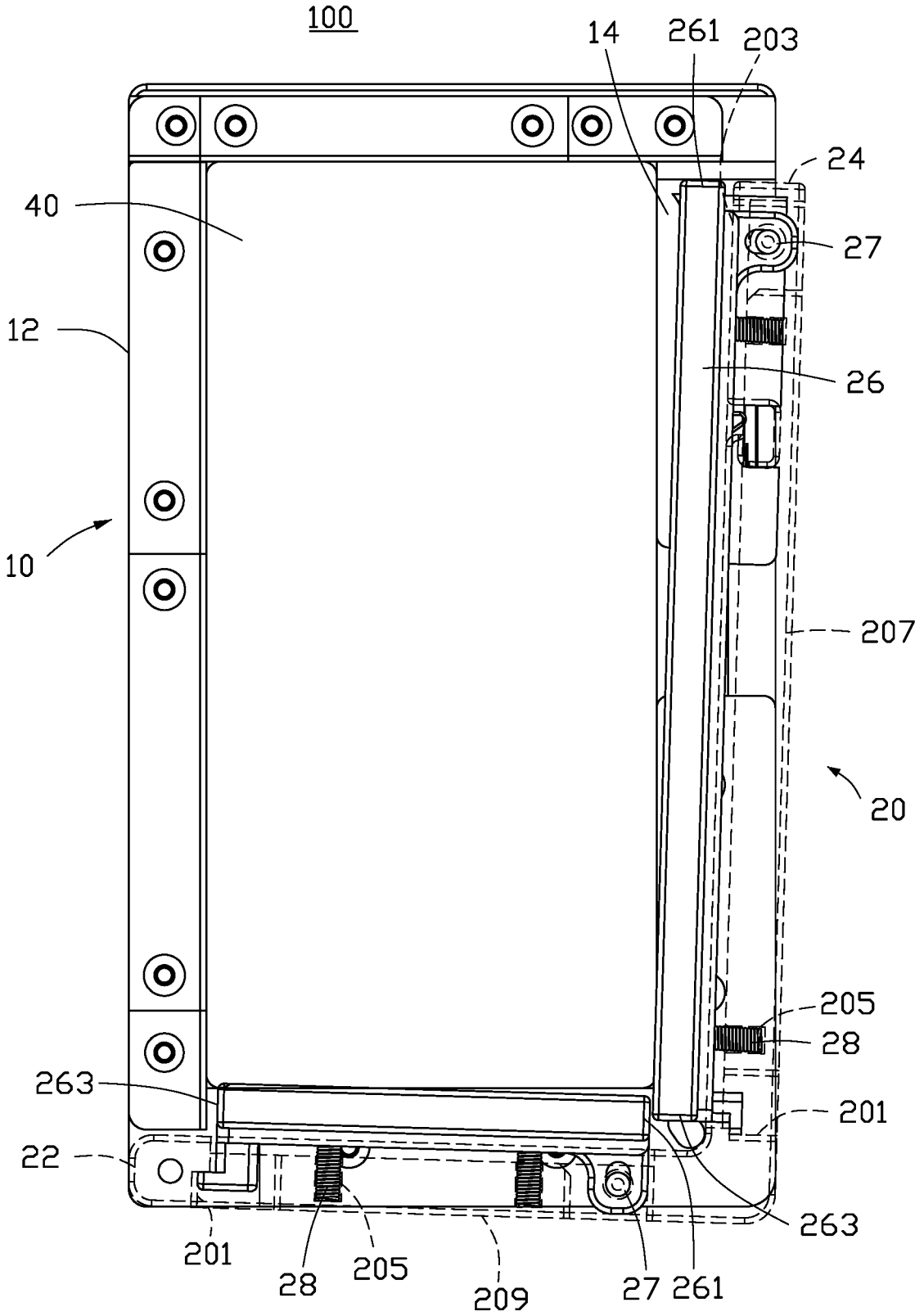
FIG. 2 is an assembled, top view of the pivoting clamping assembly of claim 1 during a process of clamping a workpiece.

Referring to FIG. 2, when the workpiece 40 is needed to be clamped, the workpiece 40 is placed on the carrier 10 such that two adjacent sides of the workpiece 40 abut against the L-shaped first portion 12. The clamping arm 20 pivotably coupled to the second portion 14 can pivot toward the workpiece 40 such that the two clamping blocks 26 resiliently abut against the workpiece 40. Since the rotating arm 20 pivots toward the workpiece 40, the two clamping blocks 26 do not abut against the workpiece 40 at the same time. Regarding the clamping block 26 located on the short section 209, a portion of the clamping block 26 adjacent to the hooking end 263 abuts against the workpiece 40 before a portion adjacent to the pivoting joint 261. Likewise for the clamping block 26 located on the long section 207, a portion of the clamping block 26 adjacent to the hooking end 263 abuts against the workpiece 40 before a portion adjacent to the pivoting joint 261.

Figure 3:
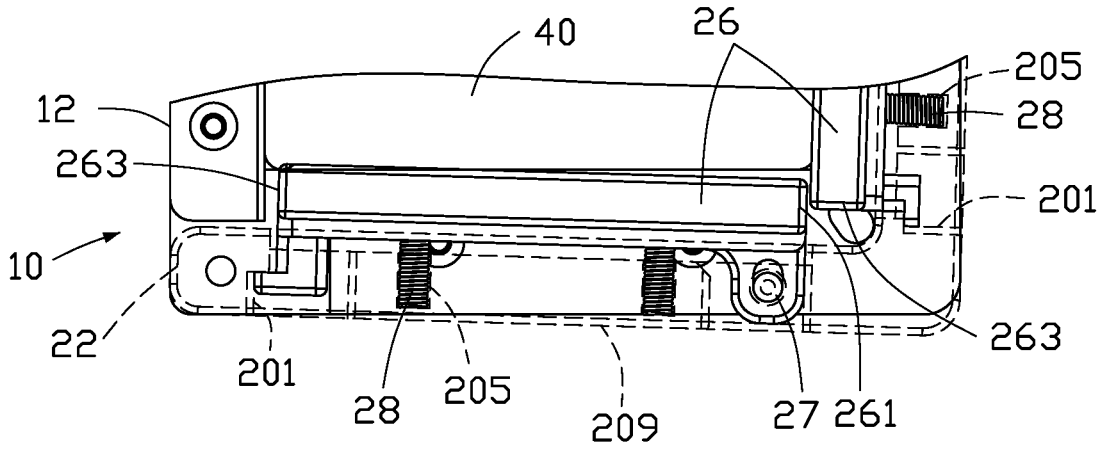
FIG. 3 is a close up cutaway view of a short section of a clamping arm of the clamping assembly.

Referring to FIG. 3, after the portion of the clamping block 26 adjacent to the hooking end 263 abuts against the workpiece 40, the portion adjacent to the pivoting joint 261 can resiliently pivot to follow the motion of the clamping arm 20 to abut against the workpiece 40. Thus, the clamping arm 20 won't get stuck and can completely abut against the workpiece 40 to cooperatively clamp the workpiece 40 with the first portion 12. When the locking end 24 of the clamping arm 20 is locked by the lock 30, the workpiece 40 can be clamped securely by the first portion 12 and the clamping arm 20 to ensure accurate positioning of the workpiece 40. Furthermore, when the lock 30 releases the locking end 24 and the clamping arm 20 is pivoted away from the workpiece 40, the resilient members 28 can restore an original position of the clamping blocks 26 on the clamping arm 20 to ensure that the clamping arm 20 can continue to accurately clamp the workpiece 40 a next time. The clamping arm 20 utilizes the clamping blocks 26 being able to resiliently pivot on the clamping arm 20 to accurately clamp the workpiece 40.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A pivoting clamping assembly comprising:

a carrier;

a clamping arm pivotably coupled to the carrier and configured to clamp or release a workpiece on the carrier;

a lock arranged on the carrier and configured to lock the clamping arm when the clamping arm is rotated toward the workpiece; and at least one clamping block coupled to the clamping arm by a shaft and at least one resilient member;

wherein the shaft pivotably couples a pivoting joint of the at least one clamping block to the clamping arm; and the at least one resilient member is coupled between the clamping block and the clamping arm;

wherein the clamping arm comprises a pivoting end and a locking end; the pivoting end pivotably couples the clamping arm to the carrier; the locking end is locked or released by the lock to close or open a second portion;

wherein the clamping arm comprises a long section and a short section each comprising a corresponding said clamping block on an inner side thereof, each of said clamping blocks comprises a corresponding pivoting joint and a hooking end hooked with the clamping arm, the pivoting joint of the clamping block of the long section is adjacent to the locking end, and the hooking end of the clamping block of the long section is adjacent to the short section.

2. The pivoting clamping assembly of claim 1, wherein the carrier comprises a first portion and the second portion; the clamping arm is pivotably coupled to the second portion; the first portion and the clamping arm are oppositely arranged and cooperatively clamp the workpiece.

3. The pivoting clamping assembly of claim 2, wherein the first portion and the clamping arm are each L-shaped, and the clamping arm surrounds the carrier.

4. The pivoting clamping assembly of claim 1, wherein the hooking end of said clamping block is opposite from the pivoting joint of the corresponding said clamping block; the hooking end and the pivoting joint allow the clamping block to pivot on the clamping arm.

5. The pivoting clamping assembly of claim 4, wherein the inner side of the clamping arm faces the workpiece; the clamping block abuts against the workpiece when the clamping arm closes the second portion.

6. The pivoting clamping assembly of claim 5, wherein the clamping arm defines at least one slot in the inner side for receiving the resilient member; the resilient member resiliently abuts against the clamping block.

7. The pivoting clamping assembly of claim 1, wherein the pivoting joint of the clamping block of the short section is adjacent to the long section, and the hooking end of the clamping block of the short section is adjacent to the pivoting end.

8. The pivoting clamping assembly of claim 1, wherein the hooking end of the clamping block of the long section and the pivoting joint of the clamping block of the short section are adjacent to each other at a junction of the long section and the short section.

* * * * *